US005616047A

United States Patent [19]

Lutsch

[11] Patent Number: 5,616,047

[45] Date of Patent: Apr. 1, 1997

[54] INSULATION DISPLACEMENT CONTACT TERMINAL

[75] Inventor: Harald M. Lutsch, Dietzenbach, Germany

[73] Assignee: The Whitaker Corporation, Wilmington, Del.

[21] Appl. No.: 402,440

[22] Filed: Mar. 13, 1995

[30] Foreign Application Priority Data

Mar. 17, 1994 [GB] United Kingdom ..... 9405294

[51] Int. Cl.[6] ..... H01R 4/24

[52] U.S. Cl. ..... 439/397; 439/395

[58] Field of Search ..... 439/397–401, 439/406, 395, 396

[56] References Cited

U.S. PATENT DOCUMENTS

| | | | |
|---|---|---|---|
| 3,845,455 | 10/1974 | Shoemaker | 439/399 |
| 4,035,049 | 7/1977 | McKee | 439/399 |
| 4,050,760 | 9/1977 | Cohen | 439/399 |
| 4,940,425 | 7/1990 | Hass et al. | 439/397 |
| 4,941,842 | 7/1990 | Nakashima et al. | 439/399 |
| 5,257,945 | 11/1993 | Heng et al. | 439/406 |

FOREIGN PATENT DOCUMENTS

| | | |
|---|---|---|
| 0279508 | 8/1988 | European Pat. Off. . |
| 2130815 | 6/1984 | United Kingdom . |

*Primary Examiner*—David L. Pirlot

[57] ABSTRACT

An insulation displacement contact for engaging an electrical lead, wherein the contact has opposing contact arms and each arm includes a cutting surface followed, along the direction of insertion of the lead, by a contacting surface, both surfaces being arranged opposite the corresponding surface on the other arm, where the resiliency of the arms at the cutting surface is less than the resiliency of the arms at the contacting surface. The structure enabling reliable insulation parting, assures an effective interconnection with a conductor over time, and enables a wider range of conductive cores to be accommodated.

15 Claims, 2 Drawing Sheets

INSULATION DISPLACEMENT CONTACT TERMINAL

BACKGROUND OF THE INVENTION

1. Field of the Invention

This invention relates to an insulation displacement contact (IDC) terminal with improved contacting characteristics.

2. Description of the Prior Art

Typical prior art IDC terminals include at least one pair of opposing legs extending upward from a base section in order to define a U-shaped structure wherein the opening is for receiving a wire-type conductor so that an electrical interconnection may be established. As the wire-type conductors typically include a conductor surrounded by a protective insulating cover, in order to effect connection with the conductor it is necessary to expose a portion of the conductor to which the electrical contact may be established. In order to separate the insulation, a cutting surface is included along at least one of the legs that is inwardly directed to be in an opposing relation with the other leg. Typically, cutting surfaces are provided on each leg with the cutting surfaces being positioned in a corresponding and opposing manner to each other. The cutting surface parts the insulation as the conductor is pressed into the opening of the U-shaped slot. Subsequent the cutting surfaces, along the legs are contact surfaces that engage the conductor so that after the insulation is displaced, further insertion of the wire results in an electrical connection being established. IDC construction of this type is well known in the industry and performs satisfactorily in a wide range of applications.

However, a problem with this construction is that the combination of the U-shaped IDC slot and the necessity of slicing through the insulation prior to seating the conductor in engagement with the contact surfaces, inherently produces a structure where the cutting surfaces will be deflected further apart in response to the insertion of the conductor. As the cutting surfaces need to be located towards the free ends of the legs so that the insulation can be cut as the wire is initially seated in the opening and the contact surfaces are located near the base where the legs are joined to the base so that the contact surfaces engage the conductor after the insulation is cut, the cutting surfaces undergo greater resilient displacement and offer less normal forces than the contact surfaces. In addition, cutting through the insulation requires more force than contacting the conductor so that the greatest force is exerted at the extreme ends of the legs.

When the arms are designed to provide adequate strength for cutting the insulation, it is not uncommon for there to be little resiliency at the contacting locations. In these instances the electrical interconnection may be susceptible to failure because any external forces exerted at the interconnection will tend to displace the conductor and, as there is little resiliency available, small displacements cannot be accommodated. If the arms are constructed to provide the proper resiliency at the contact surfaces, most likely, the strength at the cutting surfaces will be insufficient to assure reliable cutting of the insulation.

Therefore, the prior art IDC terminals of this type may have cutting surfaces that are susceptible to separation as the wire is inserted into the opening, thereby only partially cutting through the insulation or the contact surfaces therebelow may have less resiliency than is necessary to form an effective and durable electrical connection. The normal process is to compromise and create a structure that tries to do both. In some cases this will be successful, especially where the size of the wire and its core are closely controlled. In other instances, it is known to provide a separate support member to provide extra stiffness to the legs at the cutting portion as the wire is being inserted into the slot to assure that proper cutting occurs. This support member may be included in the housing in which the IDC is disposed or be provided by the tooling used to push the wire into the opening. In some applications neither of these solutions is possible or it may be necessary to be able to accommodate a range of possible wire sizes.

SUMMARY OF THE INVENTION

It is an object of this invention to provide an IDC terminal where the cutting surfaces have a lesser resiliency than the contact surfaces.

This object is accomplished by providing an insulation displacement contact for engaging an electrical lead, wherein the contact comprises opposing arms, where each arm includes a cutting surface followed, along the direction of insertion of the lead, by a contacting surface, both surfaces being arranged opposite the corresponding surface on the other arm, characterized in that the resiliency of the arms at the cutting surface is less than the resiliency of the arms at the contacting surface.

It is an advantage of this invention that the terminal may accept a greater range of wire sizes than prior art IDC terminals. It is another advantage of this invention that a supporting housing is not required to maintain the desired resiliency of the legs along the cutting surfaces to assure proper insulation displacement. It is another advantage of this invention that the resilient contact surfaces may be particularly adapted to enhance interconnection with the wire.

In one embodiment of the invention, the IDC terminal is adapted to connect wires to a substrate such as a printed circuit board.

DETAILED DESCRIPTION OF THE PREFERRED EMBODIMENT

Figure 1:
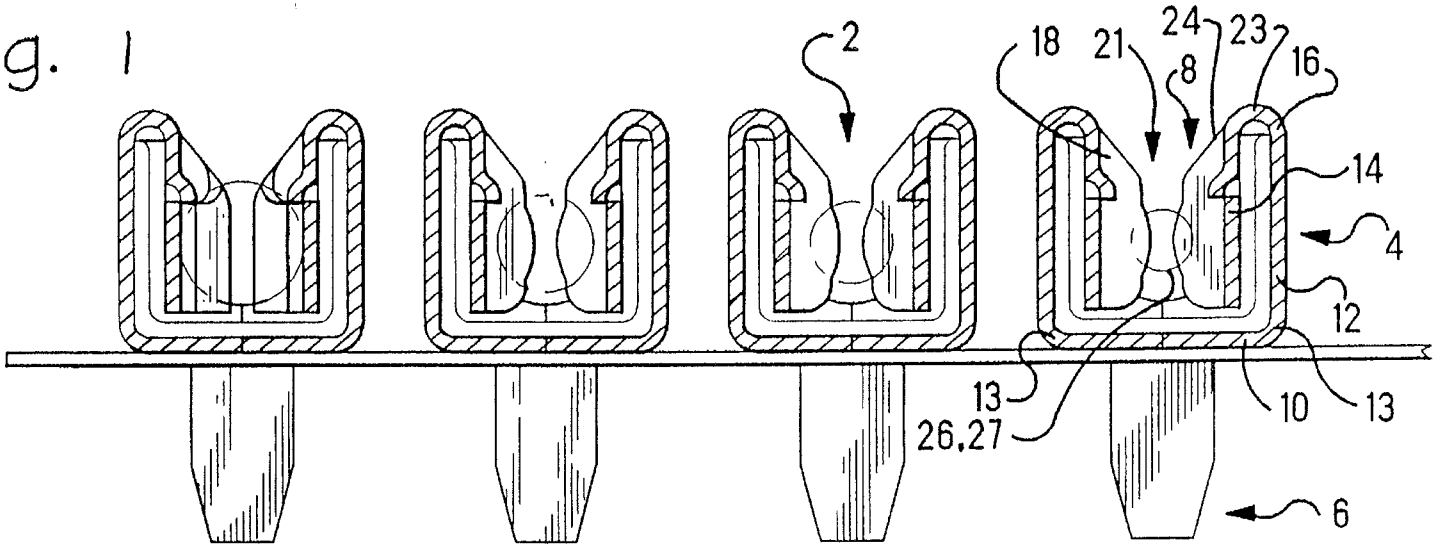
FIG. 1 is a cross-sectional view through a plurality of IDC terminals according to this invention.
Figure 2:
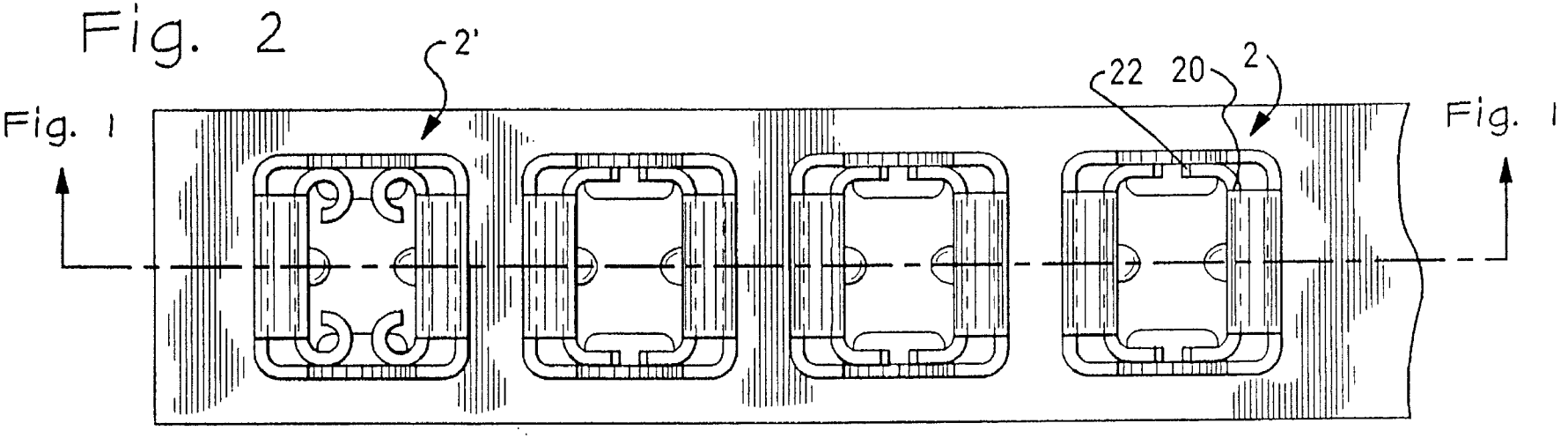
FIG. 2 is a view in the direction of arrow 2 of FIG. 1.
Figure 3:
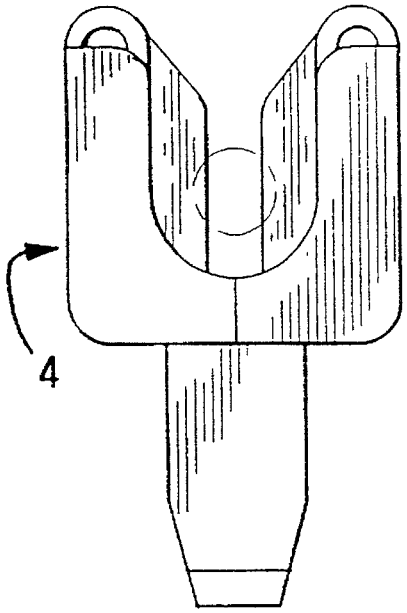
FIG. 3 is an end view of an IDC terminal.
Figure 4:
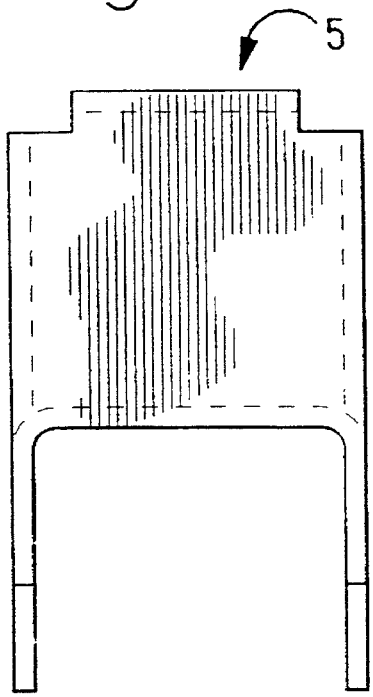
FIG. 4 is a view in the direction of arrow 4 of FIG. 3.
Figure 5:
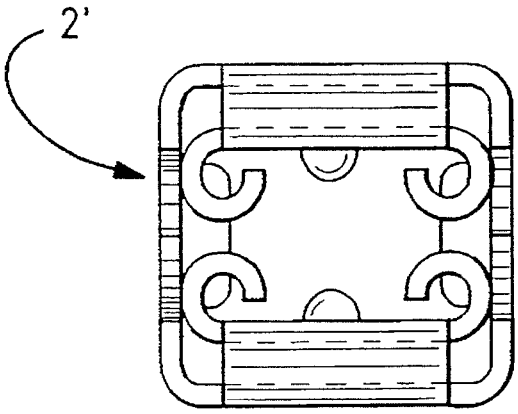
FIG. 5 is a view in the direction of arrow 5 of FIG. 4.

Referring to FIGS. 1–5, an IDC terminal 2, 2' is shown comprising a base section 4, a conductor contact section 6, and an IDC contact section 8. The conductor contact section is shown in this embodiment as being adapted for interconnection with a board, other configurations are known and may easily be utilized. The base section 4 is U-shaped and comprises a base wall 10 and side walls 12 extending from lateral edges 13 thereof. The difference between the two being that the terminal 2' uses rolled over cutting and contact surfaces, while the terminal 2 uses the edges of the material. In cases where the terminals 2,2' are stamped and formed from plated sheet, the terminal 2' enables the plated surfaces to engage the conductor, while the terminal 2 uses the unplated sheared edges. The invention will primarily be described with reference to terminal 2.

The IDC contact section 8 comprises longitudinally extending spring walls 14 extending from top edges 16 of the side walls 12 via an attachment portion 23 and having insulation displacing contact members 18 folded towards each other therefrom. The contact members 18 extend along side edges 20 of the spring walls 14. The insulation displacing contact members 18 have opposed contact edges 22 that comprise a first cutting portion 24 and a subsequent contiguous contact portion 26. The cutting portion 24 is for cutting and displacing insulation about a core conductor of a lead that is inserted between opposing contact members 18. The contact portion 26 is for establishing electrical connection with the conductive core, which may be formed of multiple conductive strands of wire, as the lead is being inserted into the terminal 2.

As the cutting portion 24 is proximate the attachment portion 23 and the contact portion 26 is close to the free end of the spring arm 14, the resilience of the spring wall 14 can be made very rigid towards the attachment portion 23. The rigidity can be maximized to assure effective cutting and displacing of the conductor insulation. The rigidity may be enhanced by providing features along the spring walls 14 or at the lateral edges 13 where the spring walls 14 join the base 10, for example by coining a feature, such as a dimple, therein.

As the conductor is inserted further down into the IDC slot 21, the suppleness of the spring wall 14 increases due to the increased length of the lever arm that exists along the spring wall 14 heading in the direction of a free-end of the contact members 18 from the attachment portion 23. Due to the high elasticity of the IDC contact portion 22, the connection with the conductor remains in the elastic range even during extreme mechanical and thermal solicitation over the lifetime of the terminal. The connection is thus reliable, durable and, additionally, the increased elasticity allows the connection to a large range of wire sizes or to stranded core wire where the strands may shift around over time due to the contacting forces, thereby changing the cross-sectional size of the conductive core.

A further advantage of the greater elasticity of the contact portion 22, is that this enables provision of an unique outwardly arcuate contact portion 22 to form the zone 27, best seen in FIG. 1. This configuration increases the contact pressure against a central portion of the conductor and acts to retain the conductor within the IDC slot 21. In the prior art, due to the high rigidity of the contact portion, it is not possible to provide such an arcuate contact zone that functions reliably, as it will tend to cut into the strands and therefore not provide increased contact pressure towards the centre of the conductor. Instead, the insulating layer of the wire in a prior art IDC slot will tend to absorb a considerable amount of the contact pressure exerted by the IDC slot and therefore reduce the contact pressure against the conducting strands of the wire.

Another advantage of this invention is that it is not necessary, as in some instances in the prior art, to dispose the IDC structure in a supporting housing which would act to back-up the cutting portion of the contact arms. Furthermore, the IDC portion 8 does not require a back-up spring structure that would also attempt to stiffen the cutting portion. To take exploit these advantages a supporting housing or additional pieces may be omitted. By incorporating tab portions formed to extend from the side walls 14 and folded over therefrom towards each other to form an end wall which acts to enclose the space between the side wall 12 and the spring walls 14, thereby preventing contaminants from entering or effecting the function of the spring walls 14. The side walls 12 and the tabs that form the end walls act to provide the IDC portion 8 with a protective outer shell. Additionally, the ends of the tabs may cooperate to provide additional stiffness to the side wall 12.

I claim:

1. An insulation displacement contact for engaging an electrical lead, wherein the contact comprises opposing arms, where each arm includes a cutting surface followed continuously and nondisjointed therewith, along the direction of insertion of the lead, by a contacting surface, both surfaces being arranged opposite the corresponding surface on the other arm, such that an IDC slot is defined therebetween for receiving the lead each arm being supported towards the cutting surface and exetnding freely therefrom in a cantilevered manner to a deflectable free-end such that the resiliency of the arms at the cutting surface is less than the resiliency of the arms at the contacting surface.

2. The insulation displacement contact of claim 1 including a conductor contact section for mounting on a board.

3. The insulation displacement contact of claim 1, further characterized in that the contact includes a second pair of contact arms longitudinally spaced from the other pair of contact arms and aligned so that both pairs engage a lead inserterd into the contact.

4. The insulation displacement contact of claim 2, further characterized in that the contact portion of each arm includes outwardly formed bulges.

5. The insulation displacement contact of claim 2, further characterized in that the contact includes a base with opposing and upstanding side walls extending therefrom, the contact arms being connected to the side walls opposite where they connect to the base and where the contact arms extend therefrom towards the base such that an open space is defined between the contact arms and corresponding side-walls.

6. The insulation displacement contact of claim 3, further characterized in that the contact is of single piece construction.

7. The insulation displacement contact of claim 3, further characterized in that the pair of opposing contact arms are folded inwardly from a spring arm 14 connected to the side walls by a transition.

8. The insulation displacement contact of claim 3, further characterized in that the cutting portion and the contacting portion are formed along a thickness edge of the material used to form the contact.

9. The insulation displacement contact of claim 3, further characterized in that the contact includes tab portions that cover an open space between the upstanding wall and the contact arm.

10. An insulation displacement contact for engaging an insulated electrical lead along the length, wherein the contact comprises a base; a pair of opposing side walls extending from the base; and opposing arms, where each arm includes a cutting surface followed continuously and nondisjointed therewith, along the direction of insertion of the lead, by a contacting surface, both surfaces being arranged opposite the corresponding surface on the other arm, the arms are connected to the side walls opposite the base and the arms are suspended therefrom in cantilevered manner between the two opposing side walls, with the cutting edge being disposed along the contact arm closer to where the arm is connected to the side wall than the contacting portion such that deflection of the arms at the cutting surface is less than the deflection of the arms at the contacting surface as the lead is inserted.

11. The contact of claim 10, wherein the contact arms are connected to a spring arm and folded inwardly therefrom to define the opening wherein the lead is received, the spring arm being connected to the side wall and cantilevered therefrom.

12. The contact of claim 10, wherein the side walls include inwardly folded tabs such that the side walls and the tabs form at least a partial housing about the contact arms.

13. The contact of claim 10, wherein the contact is of one piece construction.

14. The contact of claim 10, wherein the contacting portion includes an outwardly formed bulge.

15. The contact of claim 12, wherein the cutting and contacting portions are formed along the edges of the contact.

* * * * *